US009719328B2

(12) United States Patent
Al-Buraik

(10) Patent No.: US 9,719,328 B2
(45) Date of Patent: Aug. 1, 2017

(54) FORMATION SWELLING CONTROL USING HEAT TREATMENT

(71) Applicant: Saudi Arabian Oil Company, Dhahran (SA)

(72) Inventor: Khaled A. Al-Buraik, Doha (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 14/715,184

(22) Filed: May 18, 2015

(65) Prior Publication Data

US 2016/0341005 A1 Nov. 24, 2016

(51) Int. Cl.

| | |
|---|---|
| ***E21B 36/00*** | (2006.01) |
| ***E21B 7/00*** | (2006.01) |
| ***E21B 36/04*** | (2006.01) |
| ***E21B 47/06*** | (2012.01) |

(52) U.S. Cl.

CPC ..... *E21B 36/00* (2013.01); *E21B 7/00* (2013.01); *E21B 36/04* (2013.01); *E21B 47/065* (2013.01)

(58) Field of Classification Search

CPC . E21B 36/00; E21B 43/24; E21B 7/00; E21B 47/065

See application file for complete search history.

(56) References Cited

U.S. PATENT DOCUMENTS 3,072,188 A * 1/1963 Morse ..... E21B 36/02 166/256
3,163,745 A 12/1964 Boston
3,237,689 A * 3/1966 Justheim ..... E21B 43/2403 166/247
3,437,140 A 4/1969 Foster et al.
4,083,604 A 4/1978 Bohn
4,140,180 A 2/1979 Bridges
4,148,359 A 4/1979 Laumbach
4,265,310 A 5/1981 Britton
4,401,163 A 8/1983 Elkins
4,485,869 A 12/1984 Sresty
4,487,260 A 12/1984 Pittman
4,495,292 A * 1/1985 Siebert ..... E21B 49/006 175/50
4,705,108 A 11/1987 Little
4,793,716 A 12/1988 Wei
4,895,206 A 1/1990 Price
5,361,845 A 11/1994 Jamaluddin et al.
(Continued)

OTHER PUBLICATIONS

PCT International Search Report and Written Opinion of the International Searching Authority, PCT/US2015/058220, Feb. 19, 2016, 11 pages.

*Primary Examiner* — Robert E Fuller
(74) *Attorney, Agent, or Firm* — Fish & Richardson P.C.

(57) ABSTRACT

A downhole tool system includes a downhole tool string configured to couple to a downhole conveyance. The downhole conveyance extends into a wellbore, from a terranean surface, through at least a portion of a subterranean zone. The subterranean zone includes a geologic formation. The downhole tool system also includes a heating device coupled with the downhole tool string. The heating device is configured to transfer heat to the geologic formation in the wellbore at a specified temperature sufficient to adjust a quality of the geologic formation associated with a fluid absorption capacity of the geologic formation.

26 Claims, 4 Drawing Sheets

(56) References Cited

U.S. PATENT DOCUMENTS

| | | | | |
|---|---|---|---|---|
| 5,980,103 | A | 11/1999 | Ikuno | |
| 7,331,385 | B2 | 2/2008 | Symington | |
| 7,441,603 | B2 | 10/2008 | Kaminsky | |
| 7,559,251 | B2 | 7/2009 | Lee et al. | |
| 7,740,069 | B2 | 6/2010 | Young | |
| 7,857,056 | B2 | 12/2010 | Kaminsky | |
| 8,104,537 | B2 | 1/2012 | Kaminsky | |
| 8,308,352 | B1 | 11/2012 | Waldrop | |
| 2008/0296017 | A1* | 12/2008 | Sonne | E21B 43/24 166/264 |
| 2010/0089574 | A1* | 4/2010 | Wideman | E21B 7/14 166/272.1 |
| 2014/0151045 | A1 | 6/2014 | Galey et al. | |

* cited by examiner

FORMATION SWELLING CONTROL USING HEAT TREATMENT

TECHNICAL FIELD

This disclosure relates to formation swelling control using heat treatment.

BACKGROUND

Wellbore instability and time delayed failures due to interaction between a drilling fluid and geologic formation (for example, shale) while drilling may cause problems, both technical and financial, in drilling procedures. For example, borehole instability in geologic formations, such as shales, may increase problems, time, and cost during drilling. Problems may be time dependent, as they build up over time, such as swelling in shales during drilling. Consequences may include losing the hole in the wellbore (for example, collapse), having to manage a well control situation, or having to sidetrack. Technologies such as horizontal drilling, slim-hole drilling, and coiled-tubing drilling may not resolve borehole instability problems and, indeed, they may lead to at least as many problems as conventional drilling. Borehole instability in various geological formations may be a complex phenomenon, because certain rock formations, when in contact with water-based drilling fluids, can absorb water and ions can cause wellbore instability leading to the aforementioned issues.

SUMMARY

This disclosure describes implementations of a wellbore system that includes a downhole heating assembly. In some aspects, the downhole heating assembly may be controlled to apply or focus heat to a portion of a rock formation that defines a wellbore. In some aspects, the focused heat may be applied (for example, along with a drilling operation or subsequent to a drilling operation) at a specified temperature sufficient to reduce a capability of the rock formation to absorb a liquid, such as a drilling fluid, water, or other liquid. In some aspects, the focused heat may be applied (for example, prior to a hydraulic fracturing operation) at a specified temperature sufficient to weaken the rock formation, micro-fracture the rock formation, or both.

In an example implementation, a downhole tool system includes a downhole tool string configured to couple to a downhole conveyance that extends in a wellbore from a terranean surface through at least a portion of a subterranean zone, the subterranean zone including a geologic formation; and a heating device coupled with the downhole tool string, the heating device configured to transfer heat to the geologic formation in the wellbore at a specified temperature sufficient to adjust a quality of the geologic formation associated with a fluid absorption capacity of the geologic formation.

In a first aspect combinable with the example implementation, the quality of the geologic formation associated with the fluid absorption capacity of the geologic formation includes a cationic exchange capacity of the geologic formation.

In a second aspect combinable with any one of the previous aspects, the specified temperature is sufficient to reduce the cationic exchange capacity of the geologic formation.

In a third aspect combinable with any one of the previous aspects, the geologic formation includes a shale formation.

In a fourth aspect combinable with any one of the previous aspects, the specified temperature is between 400° C. and 500° C.

In a fifth aspect combinable with any one of the previous aspects, the heating device includes at least one of a microwave heating device, a laser heating device, or an in situ combustor.

In a sixth aspect combinable with any one of the previous aspects, the downhole tool string includes a bottom hole assembly that includes a drill bit configured to form the wellbore.

In a seventh aspect combinable with any one of the previous aspects, the heating device is configured to transfer heat to the geologic formation in a first portion of the wellbore during operation of the drill bit in a second portion of the wellbore downhole of the first portion of the wellbore.

In an eighth aspect combinable with any one of the previous aspects, the downhole conveyance includes a tubing string or a wireline.

A ninth aspect combinable with any one of the previous aspects further includes a temperature sensor positioned adjacent the heating device; and a control system configured to receive a temperature value from the temperature sensor and adjust the heating device based, at least in part, on the received temperature value.

In another example implementation, a method for treating a geologic formation includes positioning, in a wellbore, a downhole heating device that is coupled to a downhole conveyance that extends from a terranean surface to a subterranean zone that includes a geologic formation; generating, with the downhole heating device, an amount of heat power at a specified temperature to transfer to a portion of the geologic formation in the wellbore; and adjusting a quality of the geologic formation associated with a fluid absorption capacity of the geologic formation based on the generated amount of heat power at the specified temperature.

In a first aspect combinable with the example implementation, the quality of the geologic formation associated with the fluid absorption capacity of the geologic formation includes a cationic exchange capacity of the geologic formation.

In a second aspect combinable with any one of the previous aspects, the specified temperature is sufficient to reduce the cationic exchange capacity of the geologic formation.

In a third aspect combinable with any one of the previous aspects, generating, with the downhole heating device, an amount of heat power at a specified temperature to transfer to a portion of the geologic formation includes at least one of: activating a downhole laser to generate the amount of heat power at the specified temperature to transfer to the portion of the geologic formation; activating a downhole microwave to generate the amount of heat power at the specified temperature to transfer to the portion of the geologic formation; or activating a downhole combustor to generate the amount of heat power at the specified temperature to transfer to the portion of the geologic formation.

A fourth aspect combinable with any one of the previous aspects further includes focusing the generated heat power on a portion of the geologic formation in the wellbore.

A fifth aspect combinable with any one of the previous aspects further includes forming the wellbore from the terranean surface to the subterranean zone.

In a sixth aspect combinable with any one of the previous aspects, forming the wellbore from the terranean surface to the subterranean zone includes drilling through the geologic formation of the subterranean zone.

In a seventh aspect combinable with any one of the previous aspects, generating, with the downhole heating device, the amount of heat power at the specified temperature occurs simultaneously with drilling through the geologic formation of the subterranean zone.

In an eighth aspect combinable with any one of the previous aspects, generating, with the downhole heating device, the amount of heat power at the specified temperature occurs subsequently to drilling through the geologic formation of the subterranean zone.

A ninth aspect combinable with any one of the previous aspects further includes tripping a drilling assembly out of the wellbore after drilling through the geologic formation and before positioning the downhole heating device in the wellbore adjacent the portion of the geologic formation.

A tenth aspect combinable with any one of the previous aspects further includes measuring a temperature in the wellbore adjacent the portion of the geologic formation during generation of the heat power; comparing the measured temperature and the specified temperature; and based on a difference in the measured temperature and the specified temperature, adjusting the downhole heating device.

An eleventh aspect combinable with any one of the previous aspects further includes determining the specified temperature based, at least in part, on one or more of a property of a drilling fluid used to form the wellbore; a mineral property of the geologic formation; or a physical property of the geologic formation.

In a twelfth aspect combinable with any one of the previous aspects, the geologic formation includes a shale formation.

In another example implementation, a downhole tool includes a top sub-assembly configured to couple to a downhole conveyance; a housing connected to the top sub-assembly; and a heater enclosed within at least a portion of the housing and configured to transfer heat to a rock formation in the wellbore at a specified temperature sufficient to reduce a capacity of the rock formation to absorb a downhole liquid.

In a first aspect combinable with the example implementation, the heater is configured to transfer heat to the rock formation in the wellbore at the specified temperature sufficient to reduce a cationic exchange capacity of the rock formation.

In a second aspect combinable with any one of the previous aspects, the specified temperature is between 400° C. and 500° C.

In a third aspect combinable with any one of the previous aspects, the heating device includes at least one of a microwave heating device, a laser heating device, or an in situ combustor.

A fourth aspect combinable with any one of the previous aspects further includes a bottom sub-assembly configured to couple to a bottom hole assembly that includes a drill bit.

In a fifth aspect combinable with any one of the previous aspects, the heating device is configured to transfer heat to the rock formation in a first portion of the wellbore during operation of the drill bit in a second portion of the wellbore.

Implementations of a wellbore system according to the present disclosure may include one or more of the following features. For example, the wellbore system may treat (for example, with heat) a geological formation through which a wellbore is formed in order to stabilize the rock in the formation. As another example, the wellbore system may reduce or prevent swelling or other movement of the rock in the geological formation at a wall of the wellbore, such as during drilling operations with a absorbable drilling fluid (for example, water, foam, or other drilling fluid). The wellbore system may also prevent or help prevent collapse of the wellbore due to, for instance, swelling or other breakdown of the rock in the geological formation at the wall of the wellbore. The wellbore system may also increase stability of the wellbore during or subsequent to drilling operations.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1A:
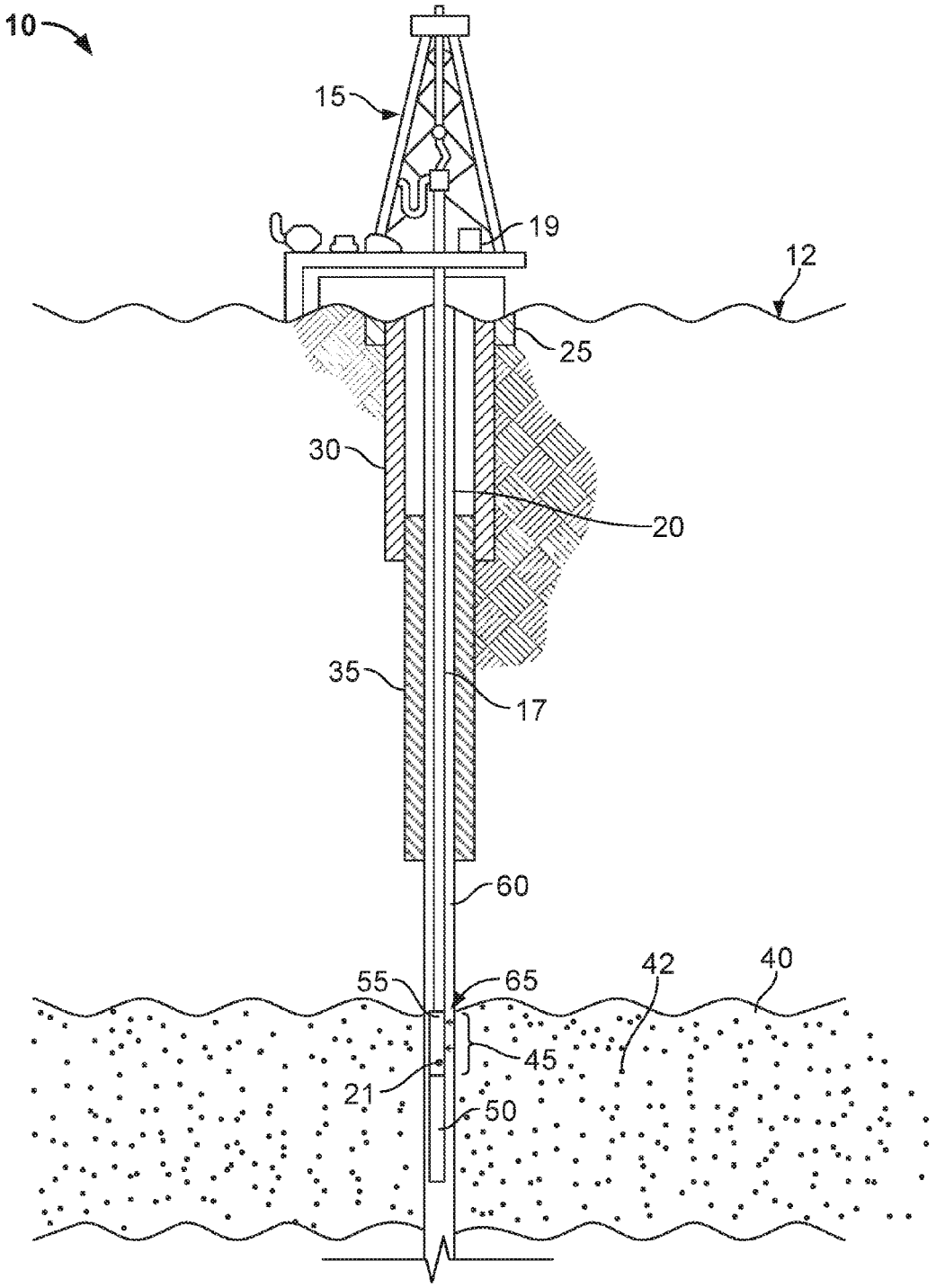
FIG. 1A is a schematic diagram of an example wellbore system that includes a downhole heat source.

FIG. 1A is a schematic diagram of an example wellbore system 100 including a downhole heater. Generally, FIG. 1A illustrates a portion of one embodiment of a wellbore system 10 according to the present disclosure in which a heating device, such as a downhole heater 55, may generate heat and apply or focus the generated heat on rock formation 42 of a subterranean zone 40. The generated heat, in some implementations may stabilize the rock formation 42, or reduce or prevent swelling or fluid absorption of the rock formation 42, or both. For example, exposure of the rock formation 42 to the generated heat may reduce the swelling potential of the rock formation 42 by adjusting or modifying one or more properties of the rock formation 42 that is associated with fluid absorption potential.

As shown, the wellbore system 10 accesses a subterranean formation 40, and provides access to hydrocarbons located in such subterranean formation 40. In an example implementation of system 10, the system 10 may be used for a drilling operation in which a downhole tool 50 may include or be coupled with a drilling bit. In another example implementation of system 10, the system 10 may be used for a completion, for example, hydraulic fracturing, operation in which the downhole tool 50 may include or be coupled with a hydraulic fracturing tool. Thus, the wellbore system 10 may allow for a drilling or fracturing or stimulation operations.

As illustrated in FIG. 1A, an implementation of the wellbore system 10 includes a drilling assembly 15 deployed on a terranean surface 12. The drilling assembly 15 may be used to form a wellbore 20 extending from the terranean surface 12 and through one or more geological formations in the Earth. One or more subterranean formations, such as subterranean zone 40, are located under the terranean surface 12. As will be explained in more detail below, one or more wellbore casings, such as a surface casing 30 and intermediate casing 35, may be installed in at least a portion of the wellbore 20.

In some embodiments, the drilling assembly 15 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

Generally, as a drilling system, the drilling assembly 15 may be any appropriate assembly or drilling rig used to form wellbores or boreholes in the Earth. The drilling assembly 15 may use traditional techniques to form such wellbores, such as the wellbore 20, or may use nontraditional or novel techniques. In some embodiments, the drilling assembly 15 may use rotary drilling equipment to form such wellbores. Rotary drilling equipment is known and may consist of a drill string 17 and the downhole tool 50 (for example, a bottom hole assembly and bit). In some embodiments, the drilling assembly 15 may consist of a rotary drilling rig. Rotating equipment on such a rotary drilling rig may consist of components that serve to rotate a drill bit, which in turn forms a wellbore, such as the wellbore 20, deeper and deeper into the ground. Rotating equipment consists of a number of components (not all shown here), which contribute to transferring power from a prime mover to the drill bit itself. The prime mover supplies power to a rotary table, or top direct drive system, which in turn supplies rotational power to the drill string 17. The drill string 17 is typically attached to the drill bit within the downhole tool 50 (for example, bottom hole assembly). A swivel, which is attached to hoisting equipment, carries much, if not all of, the weight of the drill string 17, but may allow it to rotate freely.

The drill string 17 typically consists of sections of heavy steel pipe, which are threaded so that they can interlock together. Below the drill pipe are one or more drill collars, which are heavier, thicker, and stronger than the drill pipe. The threaded drill collars help to add weight to the drill string 17 above the drill bit to ensure that there is enough downward pressure on the drill bit to allow the bit to drill through the one or more geological formations. The number and nature of the drill collars on any particular rotary rig may be altered depending on the downhole conditions experienced while drilling.

The circulating system of a rotary drilling operation, such as the drilling assembly 15, may be an additional component of the drilling assembly 15. Generally, the circulating system may cool and lubricate the drill bit, removing the cuttings from the drill bit and the wellbore 20 (for example, through an annulus 60), and coat the walls of the wellbore 20 with a mud type cake. The circulating system consists of drilling fluid, which is circulated down through the wellbore throughout the drilling process. Typically, the components of the circulating system include drilling fluid pumps, compressors, related plumbing fixtures, and specialty injectors for the addition of additives to the drilling fluid. In some embodiments, such as, for example, during a horizontal or directional drilling process, downhole motors may be used in conjunction with or in the downhole tool 50. Such a downhole motor may be a mud motor with a turbine arrangement, or a progressive cavity arrangement, such as a Moineau motor. These motors receive the drilling fluid through the drill string 17 and rotate to drive the drill bit or change directions in the drilling operation.

In many rotary drilling operations, the drilling fluid is pumped down the drill string 17 and out through ports or jets in the drill bit. The fluid then flows up toward the surface 12 within annulus 60 between the wellbore 20 and the drill string 17, carrying cuttings in suspension to the surface. The drilling fluid, much like the drill bit, may be chosen depending on the type of geological conditions found under subterranean surface 12. The drilling fluid, in some instances, or other fluids introduced into the wellbore 20, may be absorbed by the rock formation 42, causing the formation 42 to swell and possibly become unstable (for example, fall into the wellbore 20). For example, as a shale formation (or other material susceptible to liquid absorption that causes instability, swelling, or both), the rock formation 42 may contain around 60% clay material with 15% of it as active swellable clay. Other shale formations may have different consistencies of clay material or active swellable clay as well. Further, non-shale formations may also include clay material or an active swellable material. In any event, a particular criteria for determining swellability may include percent of active swellable material as well as Cationic Exchange Capacity (CEC). In some implementations, a reduction in active swellable material, which may not be possible, is one example technique for reducing swellability of the rock formation 42. In further implementations, reduction in CEC may also reduce swellability of the rock formation 42.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35.

As shown, the downhole heater 55 is positioned adjacent the downhole tool 50, for example, coupled to, coupled within a common tool string, or otherwise. Thus, the implementation of the well system 10 shown in FIG. 1A includes the downhole heater 55 as part of an additional downhole tool string or downhole tool 50. In some instances, the downhole tool string may be used for a drilling operation as described. In any event, the downhole heater 55 may be positioned to generate heat 65 to apply or focus to a portion 45 of the wellbore 20 adjacent the rock formation 42.

The downhole heater 55 may be or include at least one heating source, such as a laser heating source, a microwave heating source, or in situ combustion heating source. In some implementations, such as with an in situ combustion heating source, a combustion fuel and oxygen may be circulated (not shown) down the wellbore 20 to the downhole heater 55. In some implementations, the downhole heater 55 may generate the heat 65 without a heating source from the terranean surface 12. As illustrated, the downhole heater 55 may focus the heat 65 on to or at a particular portion 45 of the rock formation 42 that forms the wellbore 20 (for example, an uncased portion). In some aspects, the downhole heater 55 may simultaneously focus the heat 65 on all portions of the surrounding wellbore 20 (for example, in a 360° radial direction). In some aspects, the downhole heater 55 may rotate or move to focus the heat 65 on several different portions of the wellbore 20.

In any event, the downhole heater 55 may generate heat 65 at an appropriate temperature. For instance, the downhole heater 55 may generate the heat 65 to apply to the rock formation 42 to reduce a swellability or fluid absorption capacity of the rock formation 42 (for example, reduce the CEC of the rock formation 42) between about 200° C. and about 650° C.

In some aspects, the heat 65 may be generated at a sufficient temperature (for example, 400° C. to 500° C. or higher) for a sufficient duration (for example, seconds or minutes, thirty minutes, an hour, longer than an hour) to affect the rock formation 42 to reduce the CEC. In some aspects, for instance, a longer duration of heat 65 applied to the rock formation 42 may reduce the CEC of the rock formation 42 more than a shorter duration of the heat 65.

In some aspects, the rig 15 (or other portion of the well system 10) may include a control system 19, for example, microprocessor-based, electro-mechanical, or otherwise, that may control the downhole heater 55 based at least in part on a sensed temperature of the heat 65 (for example, sensed by one or more temperature sensors 21 in the wellbore). For example, the control system 19 (also shown in FIG. 1B as control system 119) may receive a continual or semi-continual stream of temperature data from the sensors 21 (also shown in FIG. 1B as sensors 121) and adjust the downhole heater 55 based on the temperature data. If the temperature data indicates that the heat 65 is at a temperature lower than a specified temperature, then the downhole heater 55 may be adjusted to output more heat 65. If the temperature data indicates that the heat 65 is at a temperature higher than a specified temperature, then the downhole heater 55 may be adjusted to output less heat 65. In some aspects, the control system 19 may control the downhole heater 55 to operate for a specified time duration.

Figure 1B:
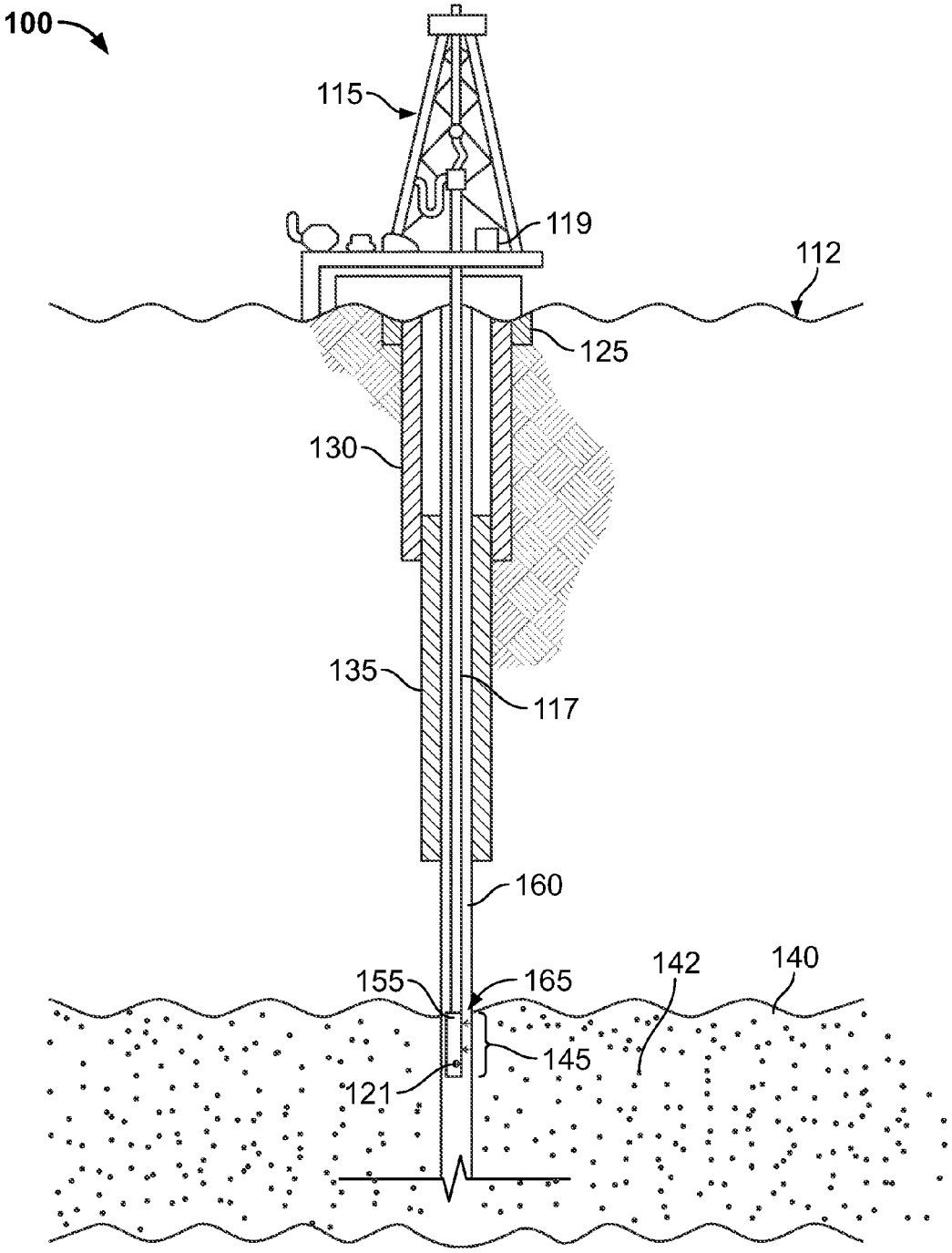
FIG. 1B is a schematic diagram of another example wellbore system that includes a downhole heat source.

FIG. 1B is a schematic diagram of another example wellbore system that includes a downhole heat source. Generally, FIG. 1B illustrates a portion of one embodiment of a wellbore system 100 according to the present disclosure in which a heating device, such as a downhole heater 155, may generate heat and apply or focus the generated heat on rock formation 142 of a subterranean zone 140. The generated heat, in some implementations may stabilize the rock formation 142, reduce or prevent swelling or fluid absorption of the rock formation 142, or both. For example, exposure of the rock formation 142 to the generated heat may reduce the swelling potential of the rock formation 142 by adjusting or modifying one or more properties of the rock formation 142 that is associated with fluid absorption potential.

As shown, the wellbore system 100 accesses a subterranean formation 140, and provides access to hydrocarbons located in such subterranean formation 140. In an example implementation of system 100, the system 100 may be used for an independent heating operation, for example, after a drilling operation to reduce a swellability of the rock formation 142 or prior to a fracturing operation to weaken the rock formation 142. Thus, in the illustrated implementation, the downhole heater 155 may be run into the wellbore 120 without another downhole tool. Of course, other downhole tools may be coupled in the tubular string 117 according to the present disclosure.

One or more subterranean formations, such as subterranean zone 140, are located under the terranean surface 112. Further, one or more wellbore casings, such as a surface casing 130 and intermediate casing 135, may be installed in at least a portion of the wellbore 120. In some embodiments, the rig 115 may be deployed on a body of water rather than the terranean surface 112. For instance, in some embodiments, the terranean surface 112 may be an ocean, gulf, sea, or any other body of water under which hydrocarbon-bearing formations may be found. In short, reference to the terranean surface 112 includes both land and water surfaces and contemplates forming and developing one or more wellbore systems 100 from either or both locations.

As described previously, the drilling fluid, in some instances, or other fluids introduced into the wellbore 120, may be absorbed by the rock formation 142, causing the formation 142 to swell and possibly become unstable (for example, fall into the wellbore 120). For example, as a shale formation (or other material susceptible to liquid absorption that causes instability, swelling, or both), the rock formation 142 may contain around 60% clay material with 15% of it as active swellable clay. Other shale formations may have different consistencies of clay material or active swellable clay as well. Further, non-shale formations may also include clay material or an active swellable material. In any event, a particular criteria for determining swellability may include percent of active swellable material as well as Cationic Exchange Capacity (CEC). In some implementations, a reduction in active swellable material, which may not be possible, is one example technique for reducing swellability of the rock formation 142. In further implementations, reduction in CEC may also reduce swellability of the rock formation 142. Thus, the downhole heater 155 may be run into the wellbore 120 and operated to generate heat 165 to, for example, reduce the swellability of the rock formation 142 by reducing the CEC of the formation 142.

The downhole heater 155 may be or include at least one heating source, such as a laser heating source, a microwave heating source, or in situ combustion heating source. In some implementations, such as with an in situ combustion heating source, a combustion fuel and oxygen may be circulated (not shown) down the wellbore 120 to the downhole heater 155. In some implementations, the downhole heater 155 may generate the heat 165 without a heating source from the terranean surface 112. As illustrated, the downhole heater 155 may focus the heat 165 on to or at a particular portion 145 of the rock formation 142 that forms the wellbore 120 (for example, an uncased portion). In some aspects, the downhole heater 155 may simultaneously focus the heat 165 on all portions of the surrounding wellbore 120 (for example, in a 360° radial direction). In some aspects, the downhole heater 155 may rotate or move to focus the heat 165 on several different portions of the wellbore 120.

The downhole heater 155 may generate heat 165 at an appropriate temperature. For instance, the downhole heater 155 may generate the heat 165 to apply to the rock formation 142 to reduce a swellability or fluid absorption capacity of the rock formation 142 (for example, reduce the CEC of the rock formation 142) between about 400° C. and about 500° C. In some aspects, the heat 165 may be generated at a sufficient temperature (for example, 400° C. to 500° C. or higher) for a sufficient duration (for example, seconds or minutes, 30 minutes, an hour, longer than an hour) to affect the rock formation 142 to reduce the CEC. In some aspects, for instance, a longer duration of heat 165 applied to the rock formation 142 may reduce the CEC of the rock formation 142 more than a shorter duration of the heat 165.

Figure 2:
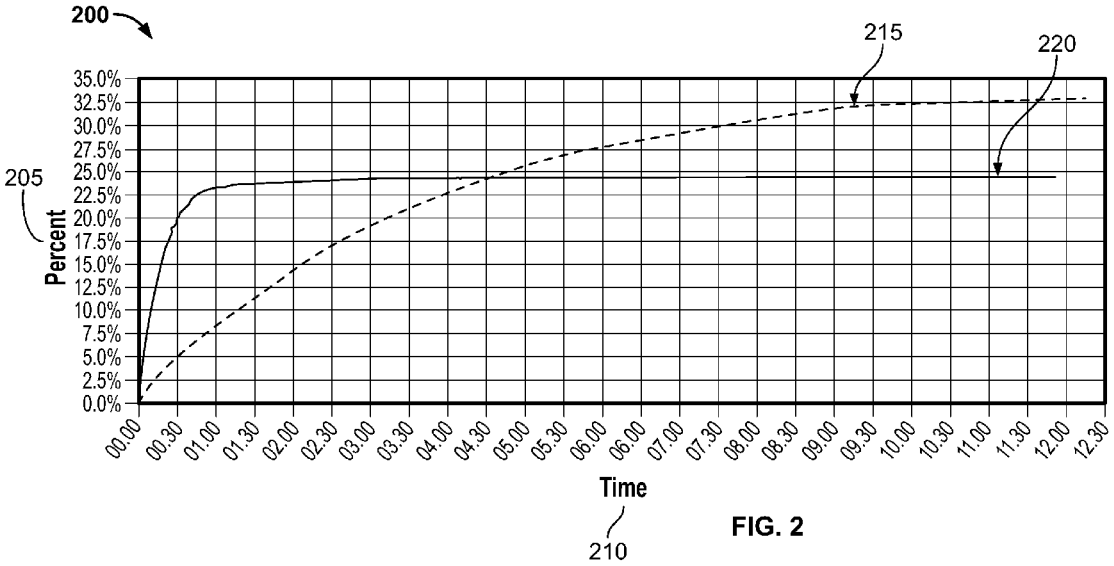
FIG. 2 is a graphical representation of an effect on a geological formation from a downhole heat source.

FIG. 2 is a graphical representation 200 of an effect on a geological formation from a downhole heat source. The graphical representation 200 includes a y-axis 205 that shows a percentage linear swelling of a rock sample, and an x-axis that shows amount of time that the rock sample was subjected to a liquid, here, fresh water. Plot 215 represents an untreated, for example, unheated rock sample, while plot 220 represents a treated, for example, heated, rock sample. The plots 215 and 220 are generated based on a linear swell meter (LSM) test. The LSM test measures free swelling of a rock sample when contacted by water. The amount of swelling the rock sample undergoes after contact with water is a measure of the reactivity of the rock sample. The LSM test can indicate a reactivity of the rock sample to the fluid used in the test.

In the example test results shown in FIG. 2, the rock sample represents a shale sample and, more particularly, a Qusaiba shale sample. Table 1 shows the composition of the sample:

TABLE 1

| Compound | Percentage |
|---|---|
| Kaolinite-$Al_2Si_2O_5(OH)_4$ | 57.0 |
| Quartz-$SiO_2$ | 23.0 |
| Muscovite | 8.9 |
| MicroclineKAI$Si_3O_8$ | 3.8 |
| Goethite-FeOOH | 1.2 |
| Gibbsite-$Al(OH)_3$ | 0.7 |
| Illite + Mixed Layers I-S | 5.4 |

In this example sample, clay (for example, illite and kaolinite) made up more than 60% of the total rock sample. The mineralogical composition of clay fraction of the shale sample. The mixed layer clays (illite-smectite) content in the total clay is 15% with 70% smectite, which is a swelling clay, as shown in Table 2.

TABLE 2

| Element/Compound | Percentage |
|---|---|
| Illite | 6 |
| Illite-Smectite | 15 |
| Kaolinite | 79 |
| Clay Size | 25 |
| % of Smectite in Illite-Smectite | 70 |

As illustrated, swell meter measurements for cylindrical pallets prepared from grinded shale samples with the compositions of Table 2 are shown: plot 215 illustrates test results for an unheated sample, while plot 220 illustrates test results for a heated sample. The heated sample was subject to heat, prior to testing, between about 200° C. and 650° C. As plot 220 illustrates, the heated sample shows 25% less linear swelling when compared to the unheated sample of plot 215 (for example, max swelling of about 32.5% for the unheated sample and max swelling of about 25% for heated sample). The heated sample also stabilized normalized swelling at 24.6% after about four hours of exposure to fresh water while the unheated sample continued to swell for a longer period of time and to a higher percentage. As shown, the unheated sample showed stability at 32.7% after 10 hours of exposure to fresh water. As also shown, the heated sample shows a faster swelling rate, which may result from dehydration of the heated sample during the heating process. This may result in rapid hydration (for example, relative to the unheated sample) when the heated sample is contacted with fresh water. After rapid hydration of the heated sample, the cationic exchange phase may dominate the sample and the swelling slows.

As part of the testing with results shown in FIG. 2, a Cation Exchange Capacity measurement was performed, which measures the cations adsorption capacity and surface within the clay structure of the shale samples. These exchangeable cations are the positively charged ions that neutralize the negatively charged clay particles. Typical exchange ions are sodium, calcium, magnesium, iron, and potassium. Most of the exchangeable ions in the shale samples are from the smectite clays, since smectite presents the largest internal surface area among all clays. As shown below in Table 3, the CEC measurements are expressed as milliequivalents per 100 g of clay (meq/100 grams). Typically, CEC is measured with an API-recommended methylene blue titration (MBT) tests. CEC gives an indication of clay activity and its potential to swell when it is interacted with water. Table 3 shows the result of the CEC tests using the MBT technique on the heated and unheated samples described previously. As shown, a reduction by 31% in CEC for the heated sample occurs relative to the unheated sample. The heated sample was subjected to heat at a temperature of about 500° C. for about thirty minutes.

TABLE 3

| Sample | meq/100 grams |
|---|---|
| Shale sample (before heating) | 22 |
| Shale sample (after heating) | 15.2 |

Figure 3:
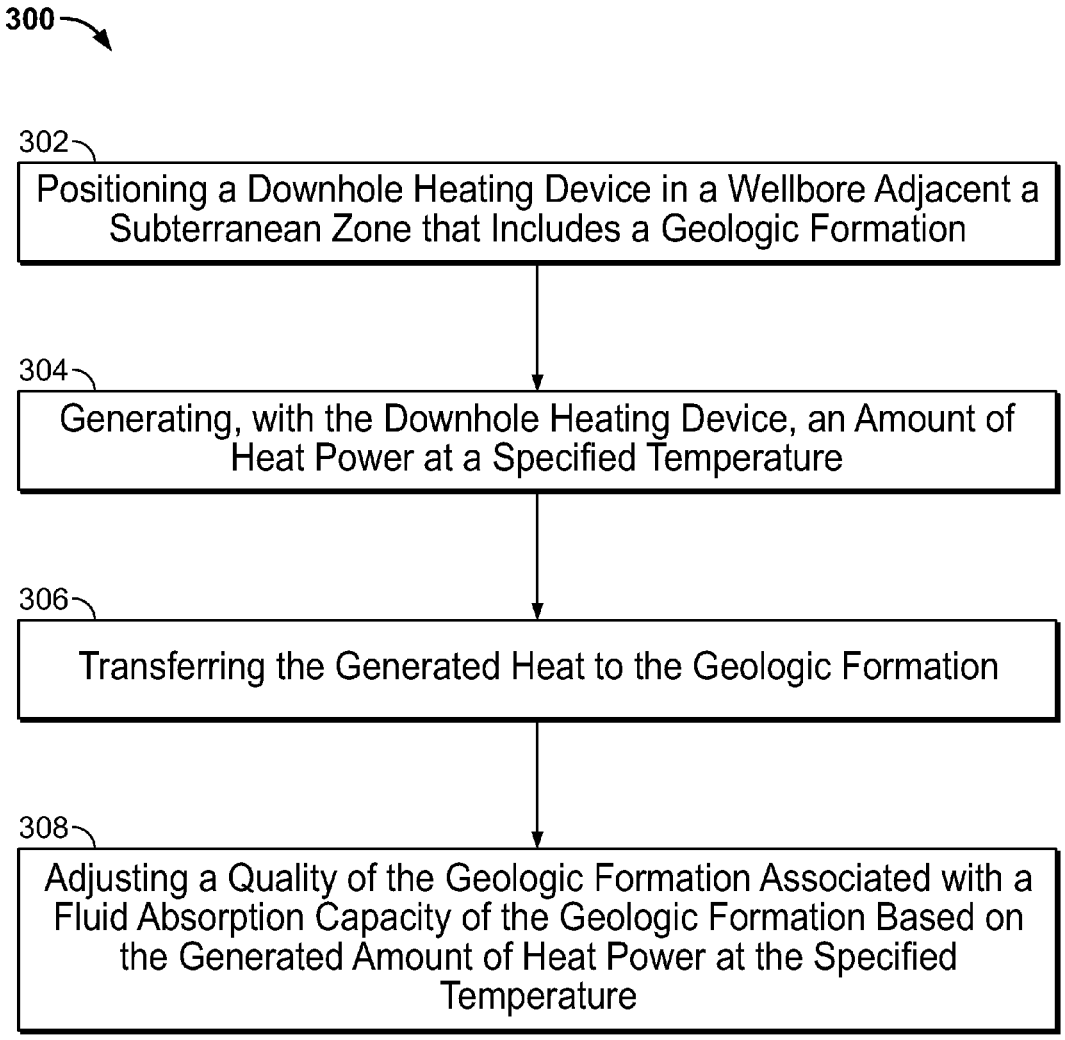
FIG. 3 is a flowchart that describes an example method performed with a wellbore system that includes a downhole heat source.

FIG. 3 is a flowchart that describes an example method 300 performed with a wellbore system that includes a downhole heat source. Method 300 may be performed with the well system 10, the well system 100, or other well system with a heating source according to the present disclosure. As described more fully below, method 300 may be implemented to stabilize the rock formation or reduce (or prevent) swelling or fluid absorption of a rock formation, such as shale.

Method 300 may begin at step 302. Step 302 includes positioning a downhole heating device in a wellbore adjacent a subterranean zone that includes a geologic (for example, rock) formation. In some aspects, the geologic formation may be shale, or other rock formation that may swell or become unstable by absorbing water or other liquid (for example, drilling fluid or other wellbore fluid). The downhole heating device may be positioned in the wellbore on a tubing string or other conveyance (for example, wireline or otherwise). In some aspects, the downhole heating device is part of or coupled to a bottom hole assembly and drill bit in a drill string, and may operate substantially simultaneously with the drill bit (for example, at another depth of the wellbore relative to the drill bit operation). In some aspects, the downhole heating device is positioned in the wellbore independently of other tools, for example, subsequent to a drilling operation.

Step 304 includes generating, with the downhole heating device, an amount of heat power at a specified temperature. In some aspects, the heat may be generated by a laser or microwave heat source of the downhole heating device. In alternative aspects, the heat may be generated by an in situ combustor (for example, steam combustor or otherwise). The generated heat may be focused on a particular portion of the wellbore (for example, a recently drilled portion) or may be applied to a substantial portion of the wellbore (for example, adjacent the swellable rock formation). In some aspects, the specified temperature may be between about 400° C.-500° C. and may be a applied for a substantial duration of time, for example, thirty minutes or more. Further, in some aspects, the specified temperature may be determined based, at least in part, on a composition or property associated with the rock formation (for example, a percentage clay of a shale formation).

Step 306 includes transferring the generated heat to the geologic formation. In some aspects, heat power or temperature may be sensed or monitored in the wellbore. The sensed or monitored temperature or heat may be used, for example, at a surface or in the wellbore, to control the downhole heating device. For instance, if the sensed temperature is less than the specified temperature, the downhole heating device may be controlled to increase the heat output.

Step 308 includes adjusting a quality of the geologic formation associated with a fluid absorption capacity of the geologic formation based on the generated amount of heat power at the specified temperature. For example, in some aspects, step 308 may include adjusting a CEC of the rock formation based on applying the heat at the specified temperature to the rock formation. By adjusting (for example, reducing) a CEC of the rock formation, the rock formation at the wellbore may absorb less liquid (for example, water, drilling fluid, or otherwise), thereby experiencing a reduction in swelling and increase in stability.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. As another example, although certain implementations described herein may be applicable to tubular systems (for example, drillpipe or coiled tubing), implementations may also utilize other systems, such as wireline, slickline, e-line, wired drillpipe, wired coiled tubing, and otherwise, as appropriate. As another example, some criteria, such as temperatures, pressures, and other numerical criteria are described as within a particular range or about a particular value. In some aspects, a criteria that is about a particular value is within 5-10% of that particular value. Accordingly, other implementations are within the scope of the following claims.

What is claimed is:

1. A downhole tool system, comprising:

a downhole tool string configured to couple to a downhole conveyance that extends in a wellbore from a terranean surface through at least a portion of a subterranean zone, the subterranean zone comprising a geologic formation, the downhole tool string comprising a bottom hole assembly that includes a drill bit configured to form the wellbore; and a heating device coupled with the downhole tool string uphole of the bottom hole assembly and the drill bit, the heating device configured to transfer heat to the geologic formation in the wellbore at a specified temperature sufficient to adjust a quality of the geologic formation associated with a fluid absorption capacity of the geologic formation, and the heating device is configured to transfer heat to a radial surface of the geologic formation in a first portion of the wellbore that is directly adjacent the heating device during operation of the drill bit in a second portion of the wellbore downhole of the first portion of the wellbore, wherein the quality of the geologic formation associated with the fluid absorption capacity of the geologic formation comprises a cationic exchange capacity of the geologic formation.

2. The downhole tool system of claim 1, wherein the specified temperature is sufficient to reduce the cationic exchange capacity of the geologic formation.

3. The downhole tool system of claim 1, wherein the geologic formation comprises a shale formation.

4. The downhole tool system of claim 3, wherein the shale formation comprises smectite clay.

5. The downhole tool system of claim 1, wherein the specified temperature is between 400° C. and 500° C.

6. The downhole tool system of claim 1, wherein the heating device comprises at least one of a microwave heating device, a laser heating device, or an in situ combustor.

7. The downhole tool system of claim 1, wherein the downhole conveyance comprises a tubing string or a wireline.

8. The downhole tool system of claim 1, further comprising:

a temperature sensor positioned adjacent the heating device; and a control system configured to receive a temperature value from the temperature sensor and adjust the heating device based, at least in part, on the received temperature value.

9. The downhole tool system of claim 1, wherein the heating device is configured to transfer heat to the geologic formation in the wellbore at the specified temperature sufficient to adjust the quality of the geologic formation associated with the fluid absorption capacity of the geologic formation to reduce an absorption of a drilling fluid, by the first portion of the wellbore in the geologic formation, during operation of the drill bit.

10. A method for treating a geologic formation, comprising:

forming a wellbore from the terranean surface to the subterranean zone with a bottom hole assembly that comprises a drill bit, where forming the wellbore from the terranean surface to the subterranean zone comprises drilling through a geologic formation of the subterranean zone;

positioning, in the wellbore, a downhole heating device that is coupled to a downhole conveyance that extends from the terranean surface to the subterranean zone that comprises the geologic formation, the downhole heating device positioned on the downhole conveyance uphole of the bottom hole assembly;

generating, with the downhole heating device, an amount of heat power at a specified temperature to transfer to a portion of the geologic formation in the wellbore, where the generating the amount of heat power at the specified temperature occurs simultaneously with drilling through the geologic formation of the subterranean zone;

applying the generated heat to a radial surface of the geologic formation in a first portion of the wellbore that is directly adjacent the downhole heating device while drilling through a second portion of the wellbore downhole of the first portion of the wellbore; and adjusting a quality of the geologic formation adjacent the first portion of the wellbore, the quality associated with a fluid absorption capacity of the geologic formation based on the generated amount of heat power at the specified temperature, the fluid absorption capacity of the geologic formation comprising a cationic exchange capacity of the geologic formation.

11. The method of claim 10, wherein the specified temperature is sufficient to reduce the cationic exchange capacity of the geologic formation.

12. The method of claim 10, wherein generating, with the downhole heating device, an amount of heat power at a specified temperature to transfer to a portion of the geologic formation comprises at least one of:

activating a downhole laser to generate the amount of heat power at the specified temperature to transfer to the portion of the geologic formation;

activating a downhole microwave to generate the amount of heat power at the specified temperature to transfer to the portion of the geologic formation; or activating a downhole combustor to generate the amount of heat power at the specified temperature to transfer to the portion of the geologic formation.

13. The method of claim 12, wherein activating a downhole combustor to generate the amount of heat power at the specified temperature to transfer to the portion of the geologic formation comprises:

circulating one or more combustion products through the wellbore to the downhole combustor; and combusting the combustion products in the downhole combustor to generate the amount of heat power.

14. The method of claim 10, further comprising focusing the generated heat power on a portion of the geologic formation in the wellbore.

15. The method of claim 10, further comprising:

forming an additional wellbore from the terranean surface to the subterranean zone, where forming the additional wellbore from the terranean surface to the subterranean zone comprises drilling through the geologic formation of the subterranean zone;

positioning, in the additional wellbore, the downhole heating device;

generating, with the downhole heating device, an amount of heat power at a specified temperature to transfer to a portion of the geologic formation in the additional wellbore, where the generating the amount of heat power at the specified temperature occurs subsequently to drilling through the geologic formation of the subterranean zone; and adjusting a quality of the geologic formation in the additional wellbore associated with a fluid absorption capacity of the geologic formation in the additional wellbore based on the generated amount of heat power at the specified temperature.

16. The method of claim 15, further comprising tripping a drilling assembly out of the additional wellbore after drilling through the geologic formation and before positioning the downhole heating device in the additional wellbore adjacent the portion of the geologic formation.

17. The method of claim 10, further comprising:

measuring a temperature in the wellbore adjacent the portion of the geologic formation during generation of the heat power;

comparing the measured temperature and the specified temperature; and based on a difference in the measured temperature and the specified temperature, adjusting the downhole heating device.

18. The method of claim 10, further comprising determining the specified temperature based, at least in part, on one or more of:

a property of a drilling fluid used to form the wellbore;

a mineral property of the geologic formation; or a physical property of the geologic formation.

19. The method of claim 10, wherein the geologic formation comprises a shale formation.

20. The method of claim 19, wherein the shale formation comprises smectite clay.

21. The method of claim 10, further comprising:

circulating a drilling fluid through the wellbore during drilling through the geological formation;

reducing an absorption of the drilling fluid, by the geologic formation, during drilling based on the generated amount of heat power at the specified temperature.

22. A downhole tool, comprising:

a top sub-assembly configured to couple to a downhole conveyance;

a housing connected to the top sub-assembly;

a heater enclosed within at least a portion of the housing and configured to transfer heat to a rock formation in the wellbore at a specified temperature sufficient to reduce a capacity of the rock formation to absorb a downhole liquid by reducing the cationic exchange capacity of the rock formation; and a bottom sub-assembly configured to couple to a bottom hole assembly that includes a drill bit, the bottom sub-assembly coupled to the top-sub-assembly downhole of the housing, wherein the heater is configured to transfer heat to a radial surface of the rock formation that surrounds the heater in a first portion of the wellbore during operation of the drill bit in a second portion of the wellbore that is downhole of the first portion of the wellbore.

23. The downhole tool of claim 22, wherein the specified temperature is between 400° C. and 500° C.

24. The downhole tool of claim 22, wherein the heater comprises at least one of a microwave heating device, a laser heating device, or an in situ combustor.

25. The downhole tool of claim 22, wherein downhole liquid comprises a drilling liquid, and the heater is configured to transfer heat to the first portion of the wellbore at the specified temperature sufficient to adjust the quality of the rock formation associated with the fluid absorption capacity of the rock formation to reduce an absorption of the drilling liquid, by the first portion of the wellbore in the rock formation, during operation of the drill bit.

26. The downhole tool of claim 22, wherein the rock formation comprises shale.

* * * * *